US009937406B2

(12) United States Patent
Dahlo

(10) Patent No.: US 9,937,406 B2
(45) Date of Patent: Apr. 10, 2018

(54) DISPOSABLE DOUBLE-EDGED SKATE BLADE

(71) Applicant: Earl Arthur Dahlo, Langley (CA)

(72) Inventor: Earl Arthur Dahlo, Langley (CA)

( * ) Notice: Subject to any disclaimer, the term of this patent is extended or adjusted under 35 U.S.C. 154(b) by 0 days.

(21) Appl. No.: 15/026,965

(22) PCT Filed: Oct. 3, 2014

(86) PCT No.: PCT/CA2014/000726

§ 371 (c)(1),
(2) Date: Apr. 2, 2016

(87) PCT Pub. No.: WO2015/048886

PCT Pub. Date: Apr. 9, 2015

(65) Prior Publication Data

US 2016/0256765 A1 Sep. 8, 2016

Related U.S. Application Data

(60) Provisional application No. 61/887,192, filed on Oct. 4, 2013.

(51) Int. Cl.
*A63C 1/32* (2006.01)
*A63C 1/30* (2006.01)

(52) U.S. Cl.
CPC ..... *A63C 1/32* (2013.01); *A63C 1/303* (2013.01)

(58) Field of Classification Search
CPC ..... A63C 1/30; A63C 1/303; A63C 1/32
See application file for complete search history.

(56) References Cited

U.S. PATENT DOCUMENTS

| | | | | |
|---|---|---|---|---|
| 1,591,778 | A * | 7/1926 | Radus | A63C 1/30 280/11.12 |
| 2,242,870 | A * | 5/1941 | Prosey | A63C 1/30 280/11.18 |
| 4,071,938 | A * | 2/1978 | Chambers | A63C 1/42 264/237 |
| 4,314,708 | A | 2/1982 | Zuuring | |
| 5,248,156 | A | 9/1993 | Cann et al. | |
| 5,769,434 | A | 6/1998 | Wurthner | |
| 6,419,241 | B1 | 7/2002 | Chenevert | |
| 6,485,033 | B2 * | 11/2002 | Nicoletti | A63C 1/303 280/11.12 |
| 6,523,835 | B1 * | 2/2003 | Lyden | A63C 1/30 280/11.12 |
| 6,761,363 | B2 | 7/2004 | Fask et al. | |
| 7,243,924 | B2 | 7/2007 | Dahlo | |

(Continued)

FOREIGN PATENT DOCUMENTS

| | | |
|---|---|---|
| CA | 2786312 | 1/2013 |
| CN | 101244334 | 8/2008 |

*Primary Examiner* — Katy M Ebner
(74) *Attorney, Agent, or Firm* — DWC Law Firm, P.S.; Ann W. Speckman; David Chen

(57) ABSTRACT

A disposable reversible skate blade for an ice skate comprising a thin runner blade held around the edges of a lightweight composite core, and a pair of opposed blade supports, which may be individually replaceable or which may be formed as an integral part of the core. The entire blade assembly is lightweight, easily removable, reversible and replaceable in a skate with little or no requirement for tools, and is inexpensive enough to manufacture that the blade is disposable.

19 Claims, 8 Drawing Sheets

(56) References Cited

U.S. PATENT DOCUMENTS

| | | | | |
|---|---|---|---|---|
| 9,427,653 | B1 * | 8/2016 | Chen | A63C 1/32 |
| 2002/0039659 | A1 * | 4/2002 | Abkowitz | A63C 1/30<br>428/472 |
| 2002/0056972 | A1 * | 5/2002 | Fask | A63C 1/32<br>280/607 |
| 2006/0103084 | A1 * | 5/2006 | Dahlo | A63C 1/32<br>280/11.12 |
| 2008/0100008 | A1 * | 5/2008 | Wan | A63C 1/32<br>280/11.18 |
| 2009/0206563 | A1 * | 8/2009 | Ferras | A63C 1/32<br>280/11.18 |
| 2010/0176564 | A1 * | 7/2010 | Koyess | A63C 1/32<br>280/11.12 |
| 2010/0194062 | A1 * | 8/2010 | Hauser | A63C 1/303<br>280/11.18 |
| 2011/0001297 | A1 * | 1/2011 | Labonte | A63C 1/32<br>280/11.12 |
| 2013/0093150 | A1 * | 4/2013 | Dahlo | A63C 1/32<br>280/11.18 |
| 2016/0256765 | A1 * | 9/2016 | Dahlo | A63C 1/303 |

* cited by examiner

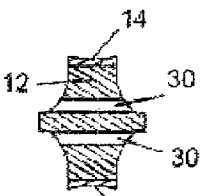
Fig 7g
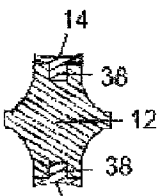
Fig 7f
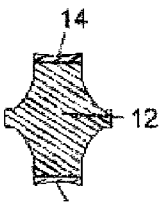
Fig 7e
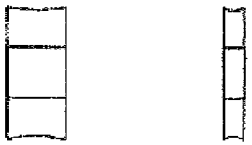
Fig 7d
Fig 7c
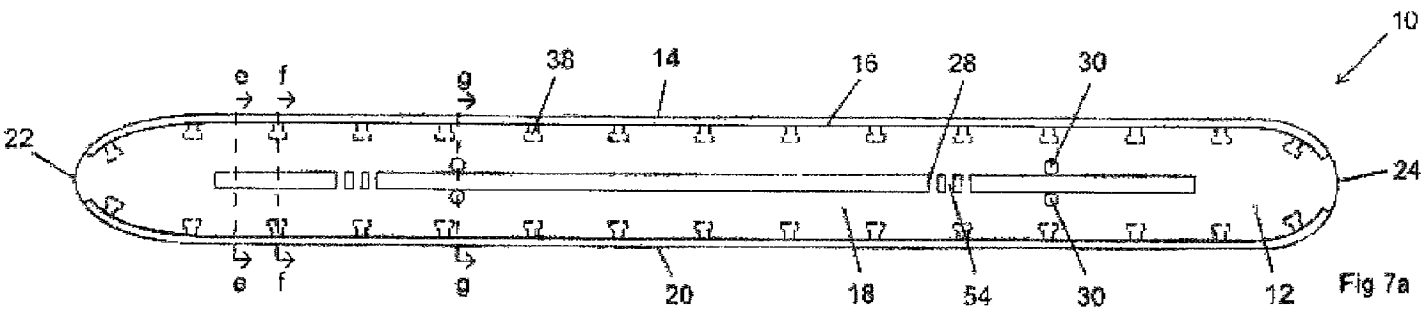
Fig 7a
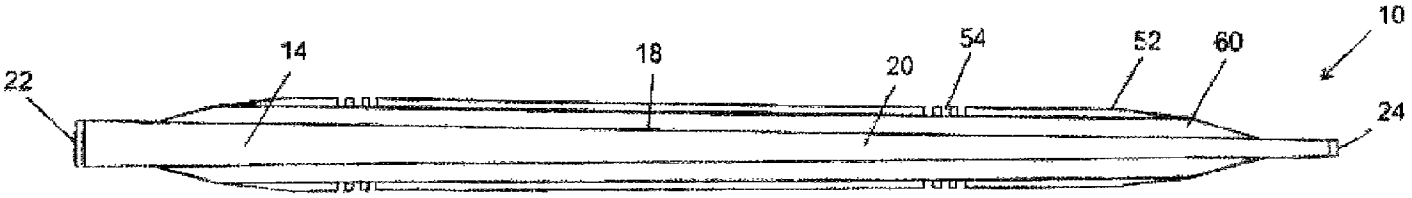
Fig 7b

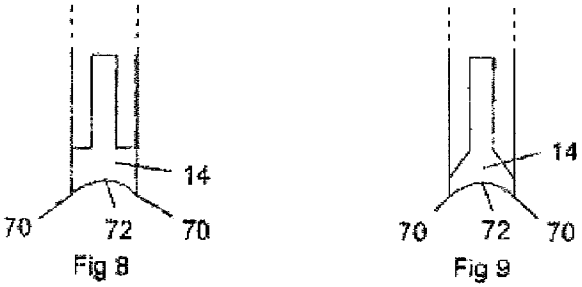
Fig 8
Fig 9
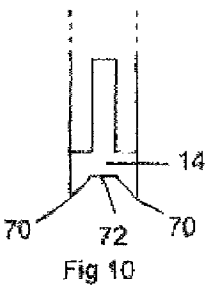
Fig 10
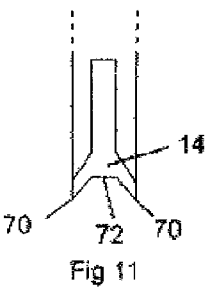
Fig 11
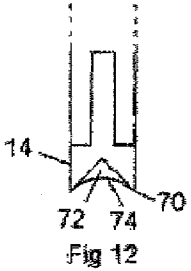
Fig 12
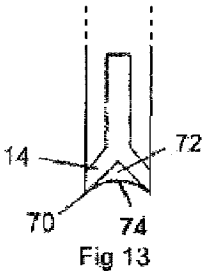
Fig 13
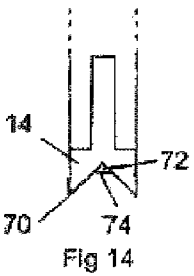
Fig 14
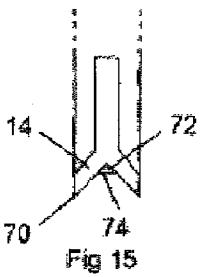
Fig 15
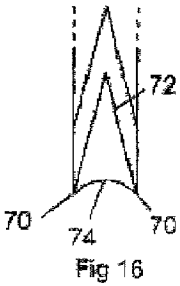
Fig 16
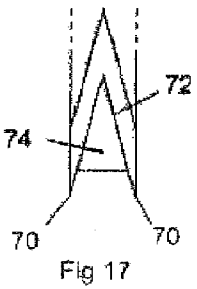
Fig 17
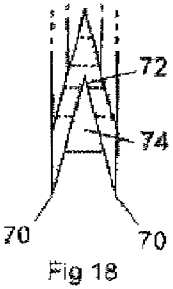
Fig 18

DISPOSABLE DOUBLE-EDGED SKATE BLADE

FIELD OF THE INVENTION

This invention relates to a double-edged skate blade that is easily removable and reversible in an ice skate and that further has a simple enough construction to make the blade and supports disposable.

BACKGROUND OF THE INVENTION

Ice hockey skates today generally comprise a sharpened metal blade or runner fastened to a holder, which is in turn fastened to a skate boot. Goaltender skates are similar, but further have a cowling to protect the lower portion of the skate boot, which might be connected to or formed integrally with the holder. Speed skates also generally comprise a sharpened metal blade held by a holder, which is then fastened to a skate boot, although the overall look and configuration of the skate is different than an ice hockey skate. In all cases, when the blade of a skate becomes dull, the surface of the blade that contacts the ice surface is re-sharpened, either to provide a hollow between a set of opposed inner and outer edges, or, in the case of a goalie skate, to provide offset or flatter edges across the thicker blade.

Current methods of skate sharpening generally require that the skate be removed from a wearer's foot. If a skater notices that a blade has become dull while he or she is on the ice, it is generally necessary to remove the skate, take it to a skate sharpening machine, sharpen the blade, and replace the skate on the skater's foot before returning to the ice. During a hockey or ringette game or a skating competition, this may be an unacceptable amount of time to be away from the ice. If there is no skate sharpener readily available, the time away from the ice is necessarily increased. The alternative is to skate on dull blades, which adversely affects the skater's speed, mobility and ability to perform necessary manoeuvres.

It is therefore preferable to be able to replace a dull blade or to simply replace an unsatisfactory blade without having to remove the skate boot from a skater's foot. U.S. Pat. No. 1,591,778 discloses a reversible blade made of a single piece of metal shaped into a generally I-shaped cross-section. The blade is meant to be reversed when one edge gets dull, and then both edges must be sharpened once both edges have become dull. There exist several other examples of removable blade systems, such as U.S. Pat. No. 6,419,241 to Chenevert, U.S. Pat. No. 6,485,033 to Nicoletti et al. and Applicant's co-pending PCT App. No. PCT/CA2012/000968, which disclose a skate blade that may be removed from a skate by removal of one or more threaded fasteners, and replaced with a new blade that is then secured with those fasteners. However, while having a reversible blade will help alleviate the urgency of finding a way to provide a freshly sharpened blade when a minimal amount of time is available, or when a skilled sharpener is not available, it is possible that a skater will suddenly find that he has used and dulled both edges of a blade.

As a further consideration, each time the blade is sharpened using standard sharpening machines and techniques, metal is physically removed from the ice-contacting or runner portion of the blade; each time metal is removed during a sharpening, the balance and feel of the skate may change. Over time the skate will eventually run out of metal blade available for sharpening, necessitating complete replacement of the blade. Because of the configuration of many skates, especially ice hockey skates, this often results in the need to either replace the entire holder or even the entire skate. Further, many skaters are particular about how their blades are sharpened, in terms of having the desired profile (radius and rocker) and hollow radius, as changes to those parameters can adversely affect the feel of the skates, and therefore the performance of the skater in a game or competition. A skater therefore must find a person who can consistently sharpen the blades to the skater's preferences, and would obviously then prefer to take the skates to that person every time. This can result in difficulty if, for example, the skater has travelled to another rink or another city for a game or competition. It is therefore preferable to provide a skate blade that does not ever need sharpening, so that when it is replaced, it reliably and consistently has the exact properties that the skater is expecting.

Further, different ice surfaces will have different properties; temperature, humidity and water quality vary from rink to rink and will produce ice surfaces that may be harder or softer than the skater is used to. As the skater may not realize how the ice feels until he has been on it for a while, such as after a warm-up, it may not be convenient or even possible to have a skate blade sharpened especially for that surface. The same considerations might even arise during a game or competition, as the temperature and humidity of the air around the rink can change substantially over time, for example if there are many spectators surrounding the rink. Again, it is likely inconvenient or impossible to have the skates sharpened for such changing conditions, as well as of course removing the metal from the blade even faster.

In such situations, it can be preferable to have a number of blades, each with varying characteristics such as with blade thicknesses, profiles (radius and rocker) and hollow radii, so that a dull or unsuitable blade can quickly be replaced with another having the properties required for the current ice surface and skating conditions. However, the cost of buying several sets of reversible blades, as well as the cost of having each sharpened twice as it becomes dull, can become prohibitive.

U.S. Pat. No. 2,242,870 discloses a reversible, double-edged blade composed of a single shaped piece of metal having a generally I-shaped cross-section. This blade is specified to be disposable, as no sharpening of the blade is contemplated. However, the presence of a substantially thinned area along the central length of the blade may tend to destabilize the blade under the lateral torque forces typically created during the skating stride and when performing other manoeuvres. A blade made completely of metal, while strong and tough, also tends to be heavy and expensive to manufacture.

Providing solid metal blades that have to be machined into various configurations, is therefore unlikely to help reduce the costs associated with carrying several sets of blades.

Because of the limitations of an all-metal blade, it is therefore known to provide a disposable blade made up of a combination of materials. U.S. Pat. No. 5,769,434 discloses a disposable blade of light, inexpensive material plus a contact blade of more expensive, harder material. However, the blade is relatively complex, including a stabilization rail of metal, carbon fibre surrounded by the blade, and a contact blade comprising a metal band either glued onto the bottom surface of the blade or held in place below the blade by an embedded strip of gripping ridges.

Another composite blade is disclosed in U.S. Pub. No. 2009/0206563, which describes a blade comprising a pair of metal plates separated by one or more metal webs, all partially encompassed by a rigid polymeric portion, which may be carbon fibre-reinforced epoxy. The metal plates form the edges of the contact blade, while the metal webs extend between the plates, leaving voids which are filled with plastic, though internal voids may be left empty. U.S. Pat. No. 6,761,363 shows a blade comprising a lower ice-contacting portion runner primarily made of metal, having a narrowed upper section around which a polymer is injection moulded, including spaced holes in the metal for secure bonding with the polymer. It is also known to sandwich a hard plastic or composite filler material between metal blade sides, as in Chinese Patent App. No. 101244334. In each case, the presence of metal substantially throughout the blade means that the blade is relatively heavy, compared to a blade comprising mostly a polymeric or other lighter material.

Canadian Patent No. 2786312 discloses a disposable composite blade comprising a metal ice-contacting edge bonded to metal foil, which is in turn wrapped around a plastic core. Additional layers may be added between the core and foil, or as external layers bonded to the foil, to increase the stiffness of the blade. A reinforcing mat pre-impregnated with epoxy/resin may be added as another wrapping layer to further increase the strength of the blade without adding substantial weight to the blade. However, the need for many layers of foil and a number of parts makes this blade relatively complex to manufacture, which tends to increase the cost of the finished product. The use of a single piece of plastic as the core may also limit the ability to optimize the blade properties.

U.S. Pat. No. 5,248,156 discloses a runner that takes the form of a thin flexible strip of metal to be secured directly to the blade holder of a skate, or to a blade inserted into the holder. The thinness and small size of the metal strip means that it may be easily disposed of, although the durability of same may be questionable. Further, the skate radius or other properties are not easily altered without permanently grinding the blade holder, and the connection mechanism is relatively complicated. Finally, the runner cannot be sharpened, nor is it reversible, meaning that it is necessary to carry a spare set of runner strips in case the blade is damaged unexpectedly.

It is therefore an object of the invention to provide a double-edged disposable blade for an ice skate that overcomes the foregoing deficiencies.

It is yet a further object of the invention to provide a reversible, disposable skate blade for a skate blade assembly having supports on either side of a skate blade to allow fast and secure removal and installation of the blade without having to remove the skate from the foot. These supports may be formed with the blade for simplicity of use, or may be separate pieces to allow for greater flexibility in replacing the various components of the blade assembly.

These and other objects of the invention will be appreciated by reference to the summary of the invention and to the detailed description of the preferred embodiment that follow. It will be noted that not all objects of the invention are necessarily realized in all possible embodiments of the invention as defined by each claim.

SUMMARY OF THE INVENTION

The invention relates to a disposable double-edged skate blade comprising a blade made of inexpensive materials, and constructed in a simple, cost-effective manner. In a further aspect, the invention relates to a disposable double-edged skate blade assembly comprising a disposable blade and blade supports to provide a snug fit within a blade holder.

In one aspect, the invention comprises a reversible disposable blade for an ice skate, the blade comprising a core having a pair of opposed planar sides bounded by two opposed edges and two curved ends; and at least one ice-contacting runner on each of the opposed edges, the ice-contacting runners and the core being composed of different materials. The runner may extend along at least one of the opposed edges and over at least one of the curved ends.

The core may be composed of materials such as aluminum, ballistic nylon, epoxy resin, fibre-reinforced polymer, fibreglass, carbon fibre, aramid polymer fibre and para-aramid polymer fibre, or combinations of these or similar materials. The core may have a thickness between the two opposed flat sides, which thickness tapers along the blade. The core may have at least one aperture through the core to accommodate a fastener to attach the blade to an ice skate.

The runner may be composed of at least one material selected from the group consisting of stainless steel, carbon steel, aluminum, titanium and ceramic, or combinations of these or similar materials. The runner may comprise a channel along its outer length and may further have a filler material in the channel.

In a further aspect, the runner and core may be connected with glue, or they may be compression molded together, or joined during an injection molding process during which the core is formed. A physical connection between the core and the runner may be provided by a plurality of protrusions on the runner, where the protrusions are embedded into the core, and/or an extension along the inner length of the runner, where the extension is embedded into the core.

In yet a further aspect, the core may be strengthened through means such as a reinforcing core within the core and/or at least one reinforcing bar extending between the opposed edges of the core.

In a further aspect, the reversible disposable blade of the invention may further include at least one blade support on each of its opposed planar sides. The blade and blade supports may be inseparable, or the blade supports may be separable from the core. If the blade supports are separable from the core, the core may further comprise at least one aperture adapted to interlock with at least one corresponding protrusion on the blade supports, and/or at least one extension adapted to interlock with at least one corresponding aperture on the blade supports.

In another aspect, the invention comprises an ice skate comprising a boot; a blade holder extending from the boot; and a detachable and reversible skate blade comprising a core having a pair of opposed planar sides bounded by two opposed edges and two curved ends; and at least one ice-contacting runner on each of the opposed edges; the ice-contacting runners and the core being composed of different materials; wherein the skate blade is disposable.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which:

FIGS. 3*c* and 3*d* are end views of the skate blade shown in FIG. 3*a;*

FIGS. 3*e*-3*h* are sectional views of the skate blade shown in FIG. 3*a*, taken along lines e-e through h-h respectively;

FIG. 7*a* is a side view of a sixth embodiment of the double-edged disposable skate blade;

FIG. 7*b* is a plan view of a long edge of the skate blade shown in FIG. 7*a;*

FIGS. 7*c* and 7*d* are end views of the skate blade shown in FIG. 7*a;*

FIGS. 7*e*-7*g* are sectional views of the skate blade shown in FIG. 7*a*, taken along lines e-e through g-g respectively; and FIGS. 8-18 are enlarged views of embodiments of a blade hollow for use with any of the embodiments of the disposable skate blade of the invention.

DETAILED DESCRIPTION OF THE INVENTION

Figure 1G:
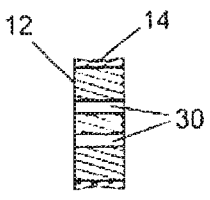
FIGS. 1*d*-1*g* are sectional views of the skate blade shown in FIG. 1*a*, taken along lines d-d through g-g respectively.
Figure 1F:
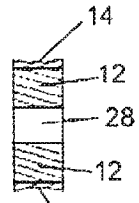
Figure 1E:
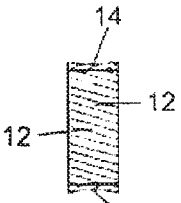
Figure 1D:
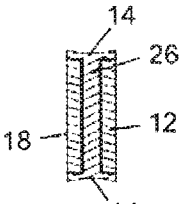
Figure 1C:
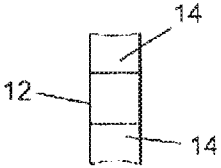
FIG. 1*c* is an end view of the skate blade shown in FIG. 1*a;*
Figure 1A:
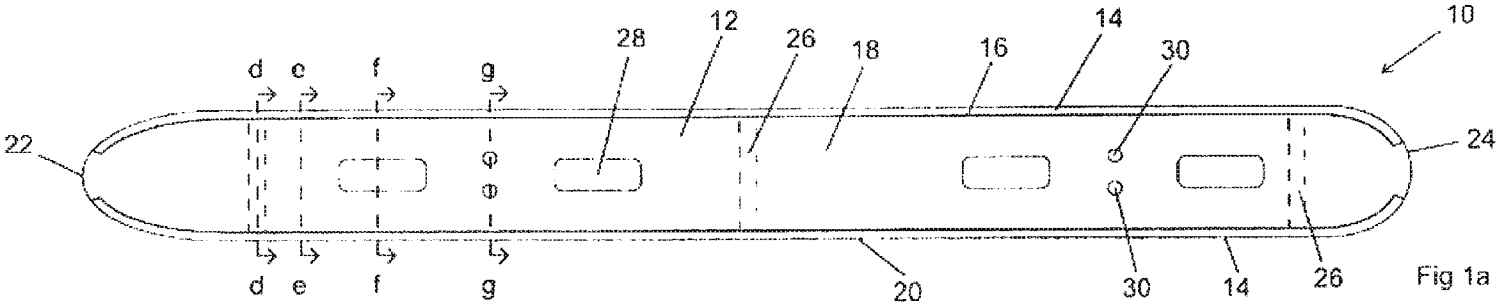
FIG. 1*a* is a side view of a first embodiment of the double-edged disposable skate blade.

Referring to FIGS. 1*a*-1*g*, a removable double edged disposable blade 10 for an ice skate includes a core 12 with an ice-contacting portion or runner 14 attached to its outer edge 16.

The core 12 may comprise a flat elongated elliptical piece having opposed flat sides 18 edged by a pair of opposed long edges 20, which comprise part of outer edge 16. It will be understood that "lower" as used in this description means the edge of the blade 10 that would contact the ice when the skate is in use, while "upper" means the portion of the blade 10 that is away from the ice and within the blade holder, but given that the blade 10 is reversible, each of the long edges 20 is interchangeable with the other and each may at any given time be the upper or lower ice-contacting edge. Each long edge 20 of the blade 10 is preferably substantially flat along its length, and is separated from the opposed long edge 20 by opposed front 22 and rear 24 curved ends, which may or may not have identical curvatures to each other.

The core 12 may be composed of any suitably strong and lightweight material, such as aluminum, ballistic nylon, an epoxy resin, a fibre-reinforced polymer such as fibreglass, carbon fibre or aramid or para-aramid polymer fibre such as Kevlar®, or a similar composite or thermoplastic material. The core may be fabricated in any manner lending itself to fast and inexpensive mass manufacture, such as injection molding, vacuum molding, compression moulding, resin transfer moulding, press moulding, autoclave moulding, transfer moulding, pultrusion composite moulding, filament winding, casting, centrifugal casting, continuous casting, vacuum infusion, wet lay-up, and thermoplastic moulding.

One or more reinforcing bars 26 may be provided to stiffen the core 12 against torsional forces, and to secure runner 14 to the edges of core 12. Although three reinforcing bars 26 are illustrated in this embodiment, it will be understood that the number and location of reinforcing bars 26 within core 12 in the figures is for illustrative purposes only, and that the number and location may vary as necessary to provide the desired balance between stiffness and weight of the blade.

Figure 6F:
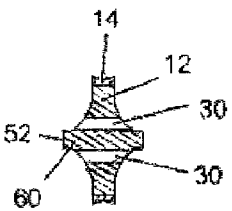
FIGS. 6*d*-6*f* are sectional views of the skate blade shown in FIG. 6*a*, taken along lines d-d through f-f respectively.
Figure 6E:
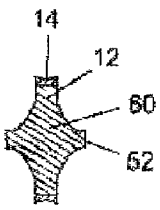
Figure 6D:
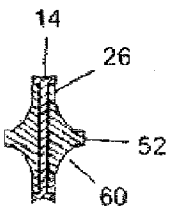
Figure 6C:
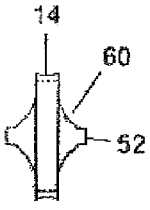
FIG. 6*c* is an end view of the skate blade shown in FIG. 6*a;*
Figure 6A:
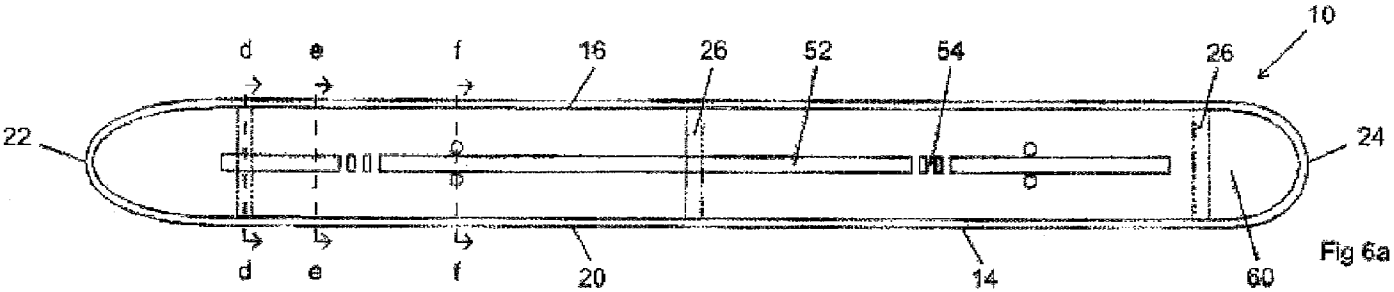
FIG. 6*a* is a side view of a fifth embodiment of the double-edged disposable skate blade.
Figure 6B:
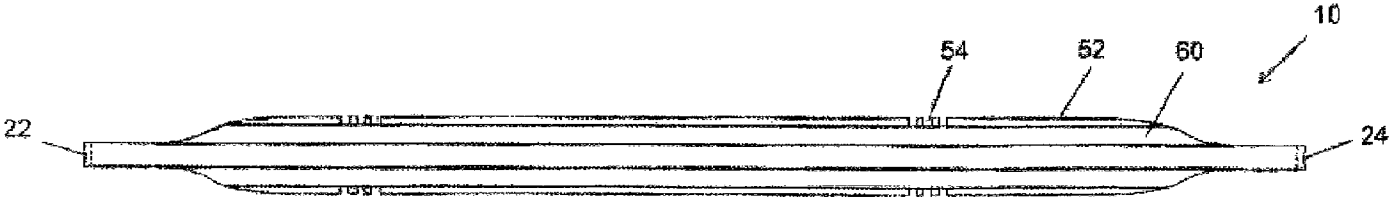
FIG. 6*b* is a plan view of a long edge of the skate blade shown in FIG. 6*a;*

The runner 14 is preferably a thin piece of stainless steel, but may also be formed of other materials, such as carbon steel, aluminum, titanium, ceramic, combinations of these materials, or other suitable material capable of holding an edge. It may be provided with different shapes and may comprise one or more filler materials to assist with gliding, as will be discussed later with reference to FIGS. 8-18. It may extend only partially around the outer edge 16 of blade core 12, as in the embodiment illustrated in FIG. 1*a*, or it may completely encompass the blade core 12, as best shown in FIG. 6*a*. The runner 14 is firmly secured to outer edge 16, such as by being in the mold during an injection moulding process, by being compression moulded to the outer edge 16, by being glued the outer edge 16 or any other suitable process to ensure firm and permanent connection to the outer edge 16. Runner 14 is relatively thin, which decreases both the cost of manufacturing the blade and the overall weight of the blade, without sacrificing the ability to provide a strong, sharp edge for optimal skating performance.

Figure 1B:
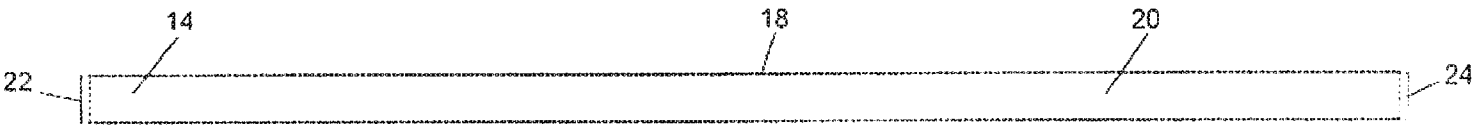
FIG. 1*b* is a plan view of a long edge of the skate blade shown in FIG. 1*a;*
Figure 2E:
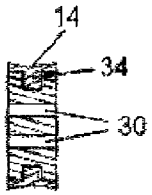
FIGS. 2*c*-2*e* are sectional views of the skate blade shown in FIG. 2*a*, taken along lines c-c through e-e respectively.
Figure 2D:
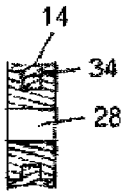
Figure 2C:
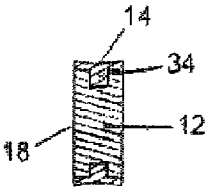
Figure 2B:
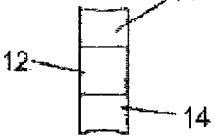
FIG. 2*b* is an end view of the skate blade shown in FIG. 2*a;*
Figure 2A:
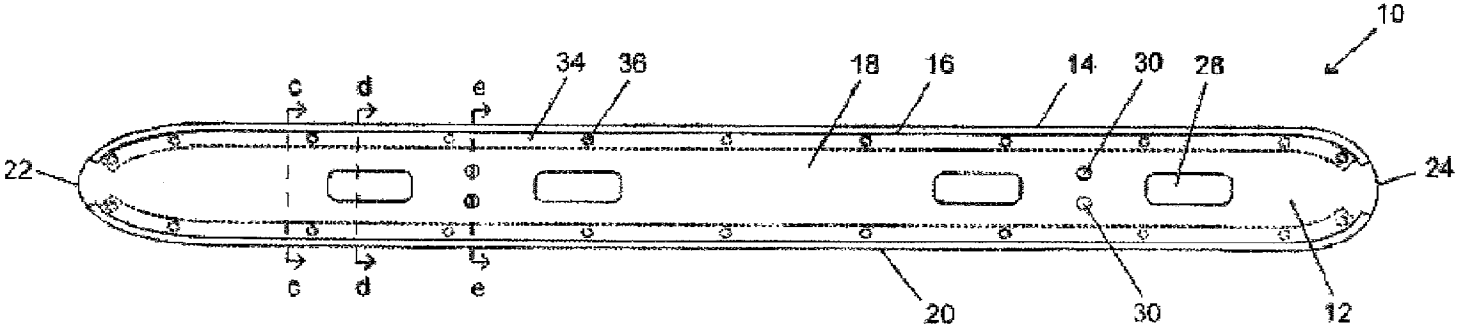
FIG. 2*a* is a side view of a second embodiment of the double-edged disposable skate blade.
Figure 3A:
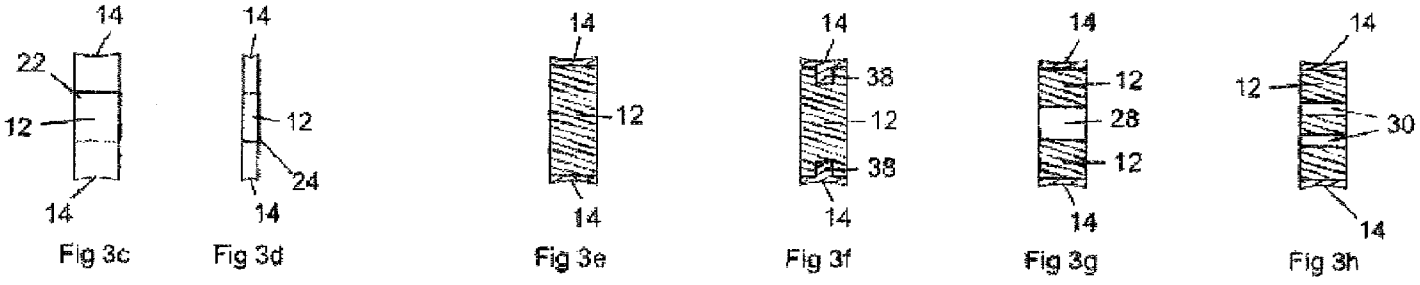
FIG. 3*a* is a side view of a third embodiment of the double-edged disposable skate blade.
Figure 3A:
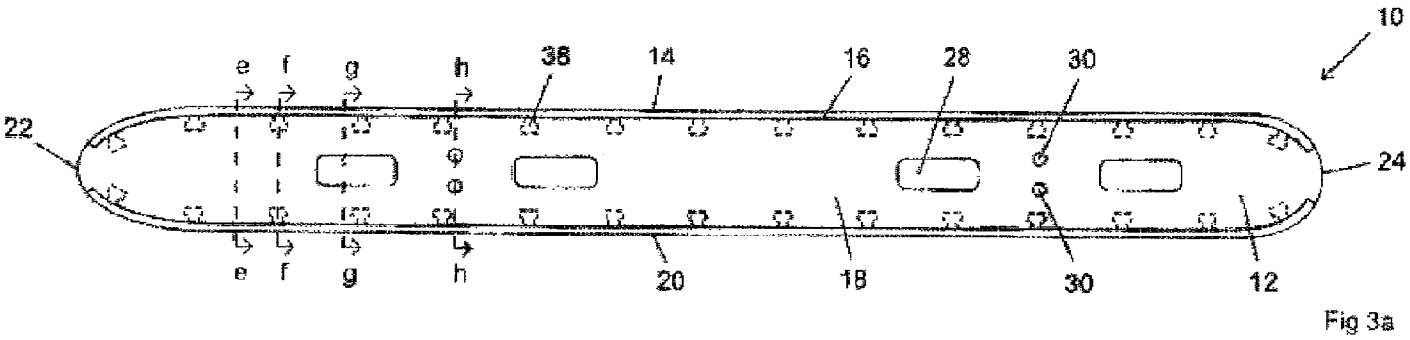
Figure 3B:
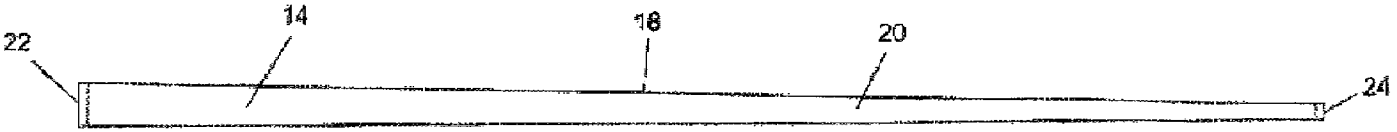
FIG. 3*b* is a plan view of a long edge of the skate blade shown in FIG. 3*a;*
Figure 4E:
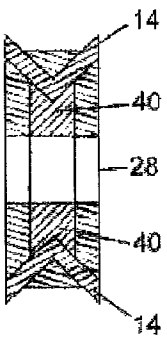
FIGS. 4*b*-4*e* are sectional views of the skate blade shown in FIG. 4*a*, taken along lines b-b through e-e respectively.
Figure 4D:
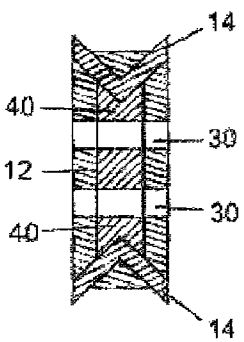
Figure 4C:
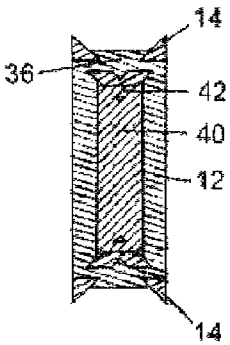
Figure 4B:
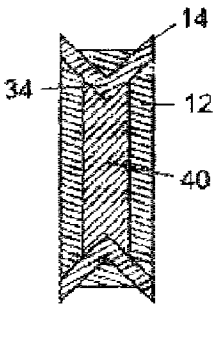
Figure 4A:
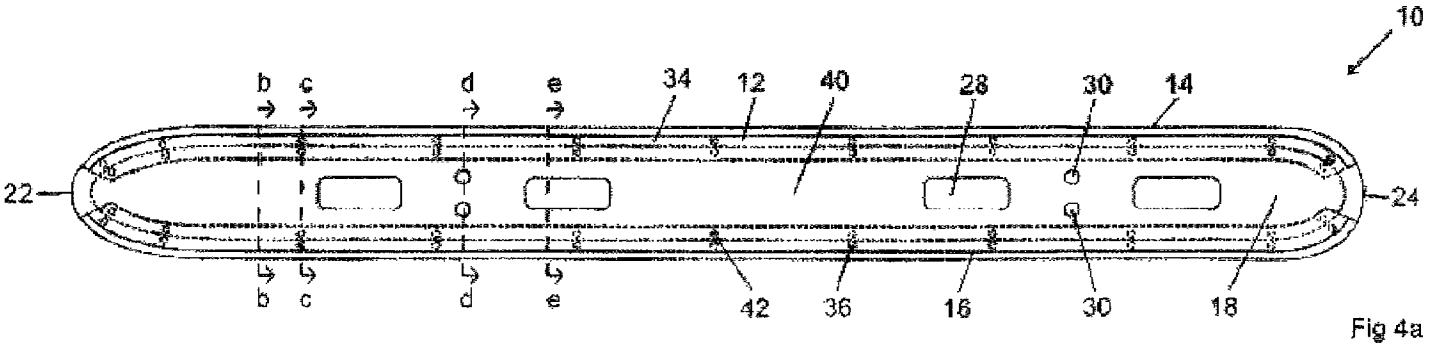
FIG. 4*a* is a side view of a fourth embodiment of the double-edged disposable skate blade.
Figure 5C:
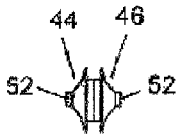
FIG. 5*c* is an end view of the pair of blade supports shown in FIG. 5*a;*
Figure 5D:
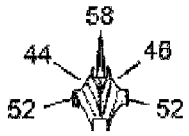
FIGS. 5*d*-5*f* are sectional views of the pair of blade supports shown in FIGS. 5*a* and 5*b*, taken along lines d-d through f-f respectively.
Figure 5E:
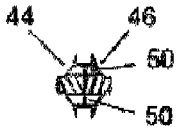
Figure 5F:
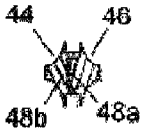
Figure 5B:
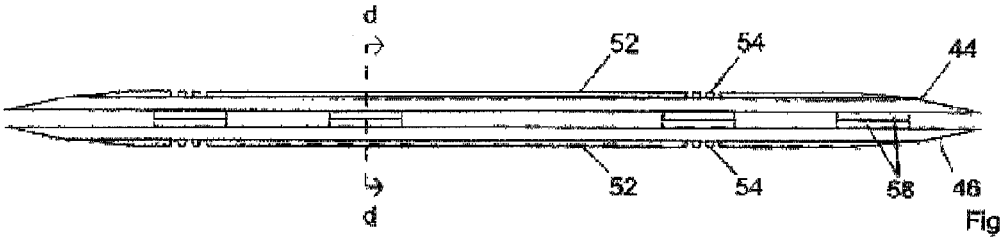
FIG. 5*b* is a plan view of the pair of blade supports shown in FIG. 5*a;*
Figure 5A:
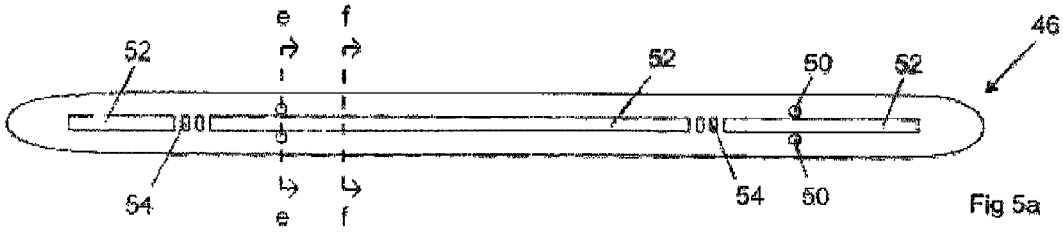
FIG. 5*a* is a side view of a pair of blade supports for use with the disposable skate blade of the invention.
Figure 5G:
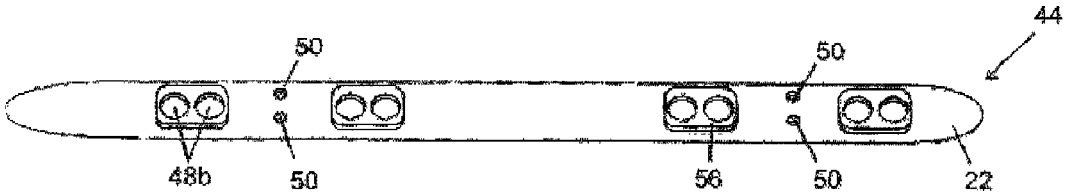
FIGS. 5*g* and 5*h* are views of the inside surfaces of the pair of blade supports shown in FIG. 5*a;*
Figure 5H:
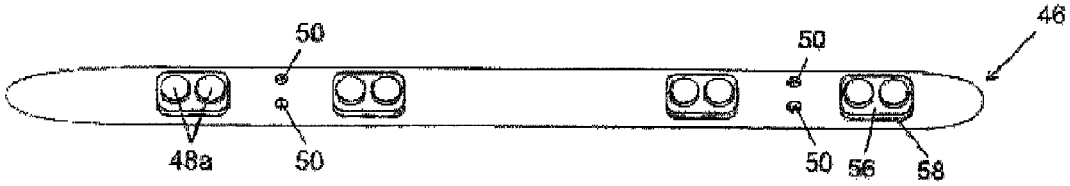

Blade core 12 may be a substantially uniform thickness along its length, as shown in FIG. 1*b*. In this configuration, it is possible to place the blade 10 within a blade holder in any one of four different configurations, as either of curved ends 22, 24 may be at the toe end of the holder, if they are identical to each other and as long as the blade 10 fits properly into the blade holder. This can simplify installment of the blade 10, because it is not necessary to be concerned about which curved end 22 or 24 is at which end of the holder. However, it is also contemplated that the thickness of the blade core 12 may be tapered from toe 22 to heel 24 along its length, as shown most clearly in FIGS. 3*b*-3*d*, which may provide improved gliding characteristics. However, it is then necessary when reversing the blade 10 to ensure that the thick end is always the front end 22, and is placed toward the front of the holder. It is also necessary to ensure during manufacture that runner 14 properly tapers along with blade core 12.

One or more apertures 30 may be provided in blade 10 through which a locking means may be used to secure the blade 10 to a holder on a skate blade. Apertures 28 may also be provided to accommodate blade supports, as will be discussed later. It will be understood that the number and placement of the apertures 28 and/or 30 may differ from that shown in the figures, as long as sufficient strength and stability characteristics may be achieved.

In a second embodiment, shown in FIGS. 2*a*-2*e*, the runner 14 is provided with an extension 34, which protrudes from its inner surface (inner being the non-ice-contacting surface), and about which core 12 is formed. In the embodiment shown in FIG. 2*a*, the core 12 simply surrounds the extension 34 directly; extensions 34 may be provided with one or more holes 36 through which the resin holding the core 12 together can flow, thereby firmly bonding the core 12 to the extension 34 and to the runner 14.

Alternatively, as best shown in the embodiment of FIGS. 3*a*-3*h*, the inner surface of runner 14 may comprise a plurality of smaller studs or pins 38, which may be gripped by the resin holding the core 12 together, thereby firmly bonding the core 12 to the studs 38 and to the runner 14.

In another embodiment, the blade 10 may be provided with a reinforcing core 40 within blade core 12. Reinforcing core 40 may be used with any of the embodiments earlier described, but as illustrated in FIGS. 4*a*-4*e*, it preferably meshes or otherwise accommodates or is accommodated by any portions of the runner 14 (such as the runner extension 34 shown in FIG. 4*a*) such that reinforcing core is solidly connected to blade core 12 and runner 14. Again, holes 36, 42 may be provided in the runner extension 34 and/or reinforcing core 40 through which the resin holding the core 12 together can flow, thereby firmly bonding the core 12 to the reinforcing core 40, the extension 34 and to the runner 14.

It is contemplated that the foregoing blade embodiments may be combined with a pair of the blade supports shown in Applicant's co-pending PCT App. No. PCT/CA2012/000968 to form the blade assembly system shown therein. A pair of blade supports 44, 46, best shown in FIGS. 5*a*-5*h*, will provide additional strength and stability through at least a portion of the length of a blade 10 (not shown in FIGS. 5*a*-5*h*). Blade supports may also provide additional strength against lateral forces. In case of a very strong lateral force, such as a puck striking the side of the blade, particularly near the centre of the blade, the force may be sufficient to deform the blade, rendering it unusable. However, with the addition of blade supports, the blade supports themselves will crack and break first, dissipating the lateral forces before they can irreversibly damage the blade. This can increase the lifetime of a blade.

Blade supports 44, 46 comprise a pair of opposed protruding ridges 52, on which the bottom of the blade holder will rest when the blade is inserted into the blade holder. Any downward force applied to the blade 10 through the skate boot and holder, such as by a skater jumping on or onto the ice, stepping, or taking strong strides, is distributed along the blade supports 44, 46. Ridges 52 may be discontinuous, as shown, or continuous, in any configuration which substantially supports the underside of the blade holder. Blade supports 44, 46 may also serve as a means to physically interlock the blade 10 with the blade holder, by providing suitable means to engage the blade supports 44, 46 and the holder. One example of such engaging means is a set of teeth 54 provided at one or more locations along the blade supports 44, 46. When the blade 10 is inserted into a holder having matching engaging means, such that the holder meshes with teeth 54 at one or more locations, the blade 10 is securely held together with the holder, preventing it from falling out unless enough force is applied to pull the blade 10 out of its engagement with the holder. Further, the meshing of the two engaging means prevents the blade 10 from moving longitudinally within the holder. When properly engaged, apertures 50 on blade supports 44, 46 line up with apertures 30 in blade 10, to accommodate a locking mechanism if required.

Blade supports 44, 46 may comprise an inner surface 56 containing alignment means to mate it with the side of blade 10, such as one or more projections 58, which align with apertures 28 in blade 10. It will be understood that any suitable alignment means may be used to correctly align the blade support 44 with blade support 46 transversely through blade 10. For example, it is also possible to mate the pieces in the opposite manner, i.e. by providing projections on blade 10 that correspond to apertures on one or both of blade supports 44, 46.

In order to ensure that the blade supports 44, 46 hold securely about the blade 10, connecting means 48 may be provided to allow the opposed blade supports to connect with each other. For example, blade support 44 may be provided with studs 48*a*, which mate with cavities 48*b* on opposed blade support 46 in a manner similar to a toy building block. It will be appreciated that other connecting mechanisms may be used, as well as different embodiments of this connecting means 48, such as more or fewer numbers of matching studs 48*a* and cavities 48*b*, or differently shaped studs 48*a* and/or cavities 48*b*.

In the embodiment shown in FIGS. 6*a*-6*f*, blade 10 is substantially the same as that shown in FIGS. 1*a*-1*g*, but an integral blade support 60 is further provided on the sides 18 of the blade 10. Blade support 60 is preferably formed as a unitary piece with core 12, such that the blade 10 has the same external features of blade supports 44, 46, such as one or more protruding ridges 52, and teeth 54 to engage a blade holder. Similarly, the other embodiments of FIGS. 1-4 may be provided with integral blade supports 60; as a further example, FIGS. 7*a*-7*g* correspond to the embodiment shown in FIGS. 3*a*-3*e*.

It is contemplated that the blade 10, while being of substantially the configuration shown, can be made with variations in blade thickness, profile (radius and rocker) and hollow radius, to suit the needs of different sports, different ice conditions, different skater size, weight, strength and skill levels, and different playing roles. For example, softer ice will require a different blade hollow radius than harder ice. A speed skater will use a thinner blade than a hockey player. A heavier skater will require a different profile than a lighter skater. A hockey player playing in a forward position may prefer a different blade profile to allow for increased maneuverability than a player playing on defense, who may skate backward more frequently than forward. A hockey goaltender will have a substantially different profile compared to a player who plays out; goalie blades are typically flat, or substantially flatter, than skater blades, and the height of one edge may differ from the height of the other edge.

Generally, both of the opposed edges 20 may have similar characteristics, such as being made of the same material, and shaped with the same hollow, profile and/or taper, such that the blade 10 comprises two opposed long edges 20 that are truly interchangeable with each other. However, it is contemplated that a blade 10 may be provided with differing characteristics between the edges 20, such as being made of different materials, or having different hollow radii and/or different profiles, such that a skater can choose which blade edge will perform best in a particular situation or under specific ice conditions without having to carry around too many replacement blades. Further, because the blades are disposable, and are therefore not intended to be sharpened, skaters who prefer specific hollow sizes and shapes can select which is the best for them, in one or more different situations. The skater can therefore know what performance characteristics to expect out of a blade each time he or she changes the blade.

Some examples of different blade configurations are shown in FIGS. 8-18. In each case, runner 14 comprises a pair of opposed edges 70, separated by a channel 72. Channel 72 may be shaped in various ways, and may be provided with a filler 74. Filler 74 may be a suitable material, chosen to improve the gliding characteristics of the blade, such as Teflon®, another polymer or a ceramic. Filler 74 may be selected to be a hydrophobic material to affect the way that the blade interacts with water that collects within the channel. A specific blade shape and hollow can be created either by physically shaping the metallic opposed edges 70 and channel 72 of the runner 14, or by using filler material 74 to provide essentially the same shape and hollow, regardless of the shape of the runner 14. This point is illustrated by a comparison of, for example, FIGS. 8-11, which show all-metal runners, with FIGS. 12-15, which show runners filled to create a matching channel shape. This provides flexibility in blade shape, composition, weight and cost of manufacture, while providing an almost unlimited number of possible blade configurations, without significantly changing the blade manufacturing process or cost. FIGS. 16-18 more clearly illustrate that several different blade channel 72 configurations may be provided using a single runner configuration, simply by providing different amounts and shapes of filler 74 between opposed runner edges 70.

In order to protect double-edged blades from damage, or from injuring the skater while not in use on a skate, a sleeve may be provided. The sleeve may also be used as a hand guard, to protect the skater's hand while removing or inserting a blade from the skate.

In the foregoing specification, the invention has been described with reference to specific embodiments thereof. However, it will be appreciated by those skilled in the art that other variations to the preferred embodiment described herein may be practised without departing from the scope of the invention, such scope being properly defined by the following claims. The scope of the claims should therefore not be limited by the preferred embodiments set forth in the examples, but should be given the broadest interpretation consistent with the description as a whole. The specification and drawings are, accordingly, to be regarded in an illustrative rather than a restrictive sense.

What is claimed is:

1. A reversible disposable blade for an ice skate, said blade comprising:

a core having a pair of opposed planar sides, each planar side bounded by two opposed edges and two curved ends; and at least one ice-contacting runner on each of said opposed edges;

said ice-contacting runners and said core being composed of different materials;

and further comprising a reinforcing core within said core.

2. The blade of claim 1 wherein said core is composed of at least one material selected from the group consisting of aluminum, ballistic nylon, epoxy resin, fibre-reinforced polymer, fibreglass, carbon fibre, aramid polymer fibre and para-aramid polymer fibre.

3. The blade of claim 1 wherein said runner is composed of at least one material selected from the group consisting of stainless steel, carbon steel, aluminum, titanium and ceramic.

4. The blade of claim 1 wherein said runner is glued to said core.

5. The blade of claim 1 wherein said runner is compression molded to said core.

6. The blade of claim 1 wherein said runner is molded to said core during an injection molding process.

7. A reversible disposable blade for an ice skate, said blade comprising:

a core having a pair of opposed planar sides, each planar side bounded by two opposed edges and two curved ends; and at least one ice-contacting runner on each of said opposed edges;

said ice-contacting runners and said core being composed of different materials; and at least one reinforcing bar extending between said opposed edges.

8. The blade of claim 1 wherein at least one of said runners further comprises a plurality of protrusions, and said protrusions are embedded into said core.

9. The blade of claim 1 wherein at least one of said runners comprises an extension along its inner length, and said extension is embedded into said core.

10. The blade of claim 1 wherein said at least one runner extends along at least one of said opposed edges and over at least one of said curved ends.

11. The blade of claim 1 wherein said core has a thickness between said two opposed flat sides and said thickness tapers along said blade.

12. The blade of claim 1 wherein said runner comprises a channel along its outer length and further comprises a filler material in said channel.

13. The blade of claim 1 further comprising at least one aperture through said core to accommodate a fastener to attach said blade to said ice skate.

14. The blade of claim 1 further comprising at least one blade support on each of said opposed planar sides.

15. The blade of claim 14 wherein said blade supports and said core are inseparable.

16. The blade of claim 14 wherein said blade supports are separable from said core.

17. The blade of claim 16 wherein said core further comprises at least one aperture adapted to interlock with at least one corresponding protrusion on said blade supports.

18. The blade of claim 16 wherein said core further comprises at least one extension adapted to interlock with at least one corresponding aperture on said blade supports.

19. An ice skate comprising:

a boot;

a blade holder extending from said boot; and a detachable and reversible skate blade comprising:

a core having a pair of opposed planar sides, each planar side bounded by two opposed edges and two curved ends; and at least one ice-contacting runner on each of said opposed edges;

said ice-contacting runners and said core being composed of different materials;

and further comprising a reinforcing core within said core;

wherein said skate blade is disposable.

* * * * *